US006228241B1

(12) United States Patent
Alwitt et al.

(10) Patent No.: US 6,228,241 B1
(45) Date of Patent: May 8, 2001

(54) ELECTRICALLY CONDUCTIVE ANODIZED ALUMINUM COATINGS

(75) Inventors: Robert S. Alwitt, Northbrook, IL (US); Yanming Liu, Columbia, SC (US)

(73) Assignee: Boundary Technologies, Inc., Northbrook, IL (US)

( * ) Notice: Subject to any disclaimer, the term of this patent is extended or adjusted under 35 U.S.C. 154(b) by 0 days.

(21) Appl. No.: 09/360,332

(22) Filed: Jul. 23, 1999

Related U.S. Application Data

(60) Provisional application No. 60/094,224, filed on Jul. 27, 1998.

(51) Int. Cl.[7] ..... C25D 7/00; C25D 11/20; C25D 5/02; C25D 5/18; B32B 17/06

(52) U.S. Cl. ..... 205/50; 428/427.2; 428/935; 205/173; 205/174; 205/118; 205/121; 205/105; 205/106; 205/224

(58) Field of Search ..... 428/472.2, 935; 205/50, 173, 174, 118, 121, 105, 106, 224

(56) References Cited

U.S. PATENT DOCUMENTS

| | | | |
|---|---|---|---|
| 3,382,160 | 5/1968 | Asada | 204/35 |
| 3,496,073 | 2/1970 | LaRoy | 204/15 |
| 3,929,593 | 12/1975 | Sugiyama et al. | 204/35 N |
| 4,431,489 | 2/1984 | Baker et al. . | |
| 4,650,708 | 3/1987 | Takahashi | 428/216 |
| 4,968,389 | 11/1990 | Satoh | 204/15 |
| 5,587,063 | 12/1996 | Kuhm et. al. | 205/173 |

FOREIGN PATENT DOCUMENTS

| | | |
|---|---|---|
| 2515-895 | 10/1976 | (DE) . |
| 53103-938 | 9/1978 | (JP) . |

OTHER PUBLICATIONS

Routke Vitch, et. al., "Nonlithographic Nano–Wire Arrays", etc., IEEE Transactions on Electron Devices, Oct., 1996, vol. 43, No. 10, p. 1646 et. seq.

Baba et. al., "Impregnation of Electrochromic W03 in the Micropores" etc., Advanced Metal Finishing Technology in Japan, 1980, p. 129, et. seq.

Zhang et. al., "Conductivity Improvement of Anodic Coatings by Ag Process", paper at AESF–Surfin '99, Jun., 1999, Cincinatti, Ohio.

Baba et al., "Impregnation of Electrochromic WO3 in the Micropores of Anodic Oxide Films of Aluminum", Advanced Metal Finishing Technology in Japan, pp. 129–133, 1980* *no month available.*

* cited by examiner

*Primary Examiner*—Edna Wong
(74) *Attorney, Agent, or Firm*—James C. Eaves, Jr.; Greenbaum Doll & McDonald PLLC

(57) ABSTRACT

A process for producing anodized aluminum with enhanced electrical conductivity, comprising anodic oxidation of aluminum alloy substrate, electrolytic deposition of a small amount of metal into the pores of the anodized aluminum, and electrolytic anodic deposition of an electrically conductive oxide, including manganese dioxide, into the pores containing the metal deposit; and the product produced by the process.

24 Claims, 1 Drawing Sheet

ELECTRICALLY CONDUCTIVE ANODIZED ALUMINUM COATINGS

PRIORITY OF PROVISIONAL

This Patent Application claims priority based on U.S. Provisional Application Number 60/094,224 filed Jul. 27, 1998. +gi The U.S. Government has a paid-up license in this invention and the right in limited circumstances to require the patent owner to license others on reasonable terms as provided for by the terms of contract number NAS8-40509 and contract number NAS8-97134 awarded by NASA Marshall Space Flight Center.

FIELD OF THE INVENTION

This invention relates to a porous anodic aluminum oxide coating with enhanced electrical conductivity and more particularly relates to a process for the anodic oxidation of an aluminum alloy substrate.

BACKGROUND OF THE INVENTION

Conventional anodized aluminum coatings contain pores with diameters of 10–20 nm that are present at very high density, ca. $10^{10}$ $cm^{-2}$. The pores are generally aligned normal to the metal surface. These pores extend through the coating thickness, with a thin "barrier" oxide, typically 10–20 nm thick, at the pore base, and, depositing material into the pores of anodic alumina in order to change the coating properties is known in the art. For example, filling with a fluorinated hydrocarbon provides lubricity, and imbibing dye into the pores can make an attractive colored surface. Depositing a small amount of certain metals into each pore creates attractive shades from gold to bronze by a light scattering phenomena. This is widely practiced commercially and is known as electrolytic coloring. This electrolytic coloring process consists generally of two steps: first, dc anodization to grow the porous oxide, for example, in sulfuric acid; and, second, an ac electrolysis in a bath containing the metal cation to be deposited. A general review of electrolytic coloring is given in chapter 8 of Vol. 1 of Wernick, Pinner and Sheasby, "The Surface Treatment and Finishing of Aluminum and its Alloys, 5th ed.". Moreover, U.S. Pat. No. 3,382,160 issued to T. Asuda on May 7, 1968, and U.S. Pat. No. 4,431,489 issued to B. R. Baker, R. L. Smith and P. W. Bolmer on Feb. 14, 1984 are examples of prior art teachings of electrolytic coloring.

Whether or not a substance is deposited in the coating pores, it is common practice to "seal" the coating by reaction with hot water, or to "cold seal" in certain chemical baths. This step is described in Chapter 11, Vol. 2 of the above referenced work by Wernick, Pinner and Sheasby. These reactions cause the coating to swell into the pores and to make it impervious to penetration by ambient atmosphere and more resistant to corrosion.

In the prior art, the pores have been used as templates to make "nano-wire arrays" by electrolytic deposition of metal or semiconductor into the pores. In this application, the deposit in a pore serves as a "wire" of a length equal to the coating thickness. The coating may either be retained as a support for the deposit or dissolved to expose the nanowires. This is described in a paper by Routkevitch et al, IEEE Trans. Electr. Dev. 43, 1646–58 (1996).

It has been found difficult to electrolytically deposit another oxide into the pores because this requires anodic conditions which will generally result in further growth of anodic aluminum oxide. For example, Baba, Yoshino and Kono (Adv. Metal Finishing Technology in Japan-1980, p. 129) found that deposition of a small amount of gold into the pores blocked anodic oxidation of aluminum during a subsequent anodic deposition of electrochromic tungsten oxide. In this way they created a layer that changed color in response to a change in voltage polarity. In order to get the strongest color change it would be necessary to fill all, or a majority, of the pores with the electrochromic oxide.

Japanese Patent JP 60,165,391 (Aug. 28, 1985) teaches electrolytically coloring anodized aluminum by directly depositing metal oxides into the pores. This reference also teaches using cathodic dc with solutions containing salts of the metal cation to be deposited, and ac with solutions containing oxyanions of the metal (oxide) to be deposited.

Anodized aluminum is widely used as the exterior surface for spacecraft because it is lightweight, easily fabricated, provides abrasion and corrosion resistance, and can be made to have a range of useful optical properties, described in terms of the coating absorptance and emittance. In a space environment the coating has a typical resistivity of $10^{14}$ ohm cm (negative bias voltage on substrate). This creates a problem during operation because an electrical charge from the space plasma builds up on the surface and cannot bleed off through this highly insulating coating. High voltages (>100 V) may develop across the coating which result in arcing and sporadic discharge with a frequency that depends on details of orbit, bias voltage and location on the spacecraft. The discharges and electrical noise interfere with communication and may cause structural damage.

SUMMARY OF THE INVENTION

It is an object of the present invention to provide a coating with enhanced conductivity so that an electrical charge can bleed off through the coating and prevent buildup of excessive voltage.

It is another object of the present invention to provide coatings with a substantial decrease in resistivity.

It is a further object of the present invention to provide a coating with decreased resistivity without degrading other coating properties.

It is also an object of the present invention to provide a coating having the ability to withstand high negative bias voltage in a vacuum plasma without arcing.

It is even a further object of the present invention to provide a coating which has corrosion resistance in ambient earth atmosphere, and suitable optical properties for thermal control in a space environment.

It has been found that the resistivity can be reduced a thousandfold by filling a fraction of the pores with $MnO_2$, an electronically conductive oxide. The filled pore fraction is controlled by a prior deposition of metal into the pores. The conditions for metal deposition are adjusted to control both the fraction of the pore population in which metal is deposited and the amount of metal deposited in each pore. These metal "nanoelectrodes" are sites on which $MnO_2$ can deposit. Only those pores in which metal has deposited can be filled with $MnO_2$. The $MnO_2$ deposit grows from the pore base, and deposition is continued until this deposit reaches the outer surface of the coating. The vacuum plasma can make electrical contact with these conductive channels.

In the use of the terms "$MnO_2$" and "manganese dioxide", these terms are names for the deposit obtained from a manganese salt solution and not meant to specify the stoichiometry. Moreover, the deposit is likely to be a mixture of $MnO_2$ and suboxides of manganese with the precise composition depending on the process conditions, such as bath temperature, pH and current density.

DETAILED DESCRIPTION OF THE PREFERRED EMBODIMENTS

The particular conditions for metal deposition and $MnO_2$ deposition are critical for making a successful coating. For efficient electrical coupling with the vacuum plasma, it is necessary to get a uniform dispersion of the $MnO_2$ filled pores over the coating surface. This requires that the metal sites be uniformly distributed. That is, "uniform" distribution means one for which the spatial distribution of conductive sites approaches a random, also known as a Poisson, distribution. A good distribution is obtained using ac electrolysis for the metal deposition similar to that used for prior art electrolytic coloring. There are two embodiments of the invention. One is to enhance the conductivity of a conventional anodic coating, for example, one grown in sulfuric acid and commonly known as clear anodize, and the other is to make a black anodize coating with enhanced conductivity. The first embodiment is intended to produce enhanced conductivity with minimal increase in coating absorptance, and is achieved by depositing metal into only a fraction of the pores; the amount of metal deposited being too little to impart any color to the coating. The second embodiment makes a coating with increased conductivity and with absorptance near unity, and is achieved by depositing metal into nearly all the pores, and then filling these pores with $MnO_2$. In this case, the metal and the conductive oxide strongly absorb solar radiation and impart a deep black coloration to the coating. The pores of conventional black anodize coatings are filled with a black organic dye or certain inorganic materials, such as stannous sulfide or cobalt sulfide, deposited by precipitation. Because the absorptance of these coatings is nearly one, they lose a minimal amount of energy by radiation and are used in ambient earth atmosphere for solar heat collectors, and on spacecraft to maintain an elevated temperature in some location.

Metals that can be deposited by ac electrolysis include cobalt, nickel, copper, tin, silver, iron, and gold. Cobalt, nickel and tin are the most commonly used cations in commercial electrolytic coloring baths, and nickel and tin have been found as the preferred cations for the present invention.

Although nickel baths are available commercially for ac anodization, tin baths are used more widely. Deposition of tin can be substituted for deposition of nickel, with all other process steps remaining essentially unchanged. For example, a suitable tin bath contains 5–20 g/l stannous sulfate, 10–25 g/l sulfuric acid, and may also contain a stabilizer to prevent oxidation of the tin cation from the stannous to stannic form. Examples of suitable stabilizers are phenol sulphonic acid, cresol sulphonic acid, and sulphophthalic acid, with others used in commercial proprietary tin baths. An example of a process sequence to make a coating with tin at the pore base consists of the steps of cleaning, sulfuric acid anodizing, tin deposition, and manganese oxide deposition. More specifically, the cleaning is carried out with alkaline cleaner at 70° C. for 2 minutes, the sulfuric acid anodizing at 15 V in a 15% sulfuric acid solution at 23° C. for 20–30 minutes. Tin deposition is at room temperature (20–23° C.), 50–60 Hz rms current of 2–8 $mA/cm^2$ for 10–15 sec. And, the manganese oxide deposition is in a 0.5M $MnSO_4$ solution, at room temperature (20–23° C.), 50 Hz pulse dc with 5–20% duty cycle, pulse current density starts at 1–10 $mA/cm^2$, total charge of 0.3–0.5 $C/cm^2$.

It is most likely that nickel or tin deposition will be done using the ac line frequency, which is 50 or 60 Hz worldwide. Other frequencies may be found to provide a more uniformly dispersed metal deposit. An optimum ac frequency will be found between 10 and 120 Hz. If a frequency other than line frequency is selected, then the most readily available power sources will provide a square waveshape rather than the sinusoidal wave from the power lines. The square waveshape will be satisfactory. In fact, complex waveshapes composed of superimposed square waves of different amplitude and period may prove to offer particular advantages. This is by analogy with other commercial processes using pulsating dc (pulse plating) and ac electroetching of aluminum. In these other processes the use of complex waveshapes results in more uniform deposits and more uniform etch structure. Thus, it is anticipated that use of these waveshapes may improve the uniformity of the distribution of metal deposit sites.

Electrolytic $MnO_2$ is prepared in commercial quantities for use in batteries by anodic deposition from a warm acidified sulfate bath. For the present invention, depending on the particular metal in the pores, it was thought that these conditions could cause dissolution of the metal deposit. It has been found that a manganese sulfate bath, with no additional sulfuric acid and operated at room temperature, also can be used to deposit the $MnO_2$. Even further, it has been found that steady dc or pulse dc can be used if the current density is sufficiently high to deposit some $MnO_2$ before the Ni (or other metal substrate) dissolves.

Furthermore, it is possible to anodically deposit other conductive metal oxides into the aluminum oxide pores, but each has a limitation. For example, ruthenium, iridium and silver oxides are too expensive, whereas the bath from which lead oxide can be deposited presents a severe health hazard and disposal problem.

This coating is designed for space applications, wherein the coating must have certain optical properties and is in contact with a vacuum plasma. The plasma has a very low electron density, so the effective coating resistivity is controlled by the electrical coupling between coating and plasma. Good coupling requires that the conductive deposit extend from the pore base to the outer surface of the coating where it can contact the plasma environment, and it is improved by increasing the density of conductive channels in the coating. But the conductive deposit affects optical properties by increasing the absorptance of solar radiation. A satisfactory coating is one with the necessary balance of electrical and optical properties for the particular application.

With a metal contact, the coating resistivity is reduced 100 times from its value in vacuum plasma. This may make the conductive coating useful for nonspace applications, such as to provide electrical continuity across anodized surfaces. This is needed for many applications, for example, for connections of aluminum parts to aluminum auto frames, where some of the aluminum members must be anodized for corrosion and abrasion resistance. For these applications the optical properties are not important, so the filled pore fraction may be increased to further reduce resistivity.

EXAMPLES

Figure 1:
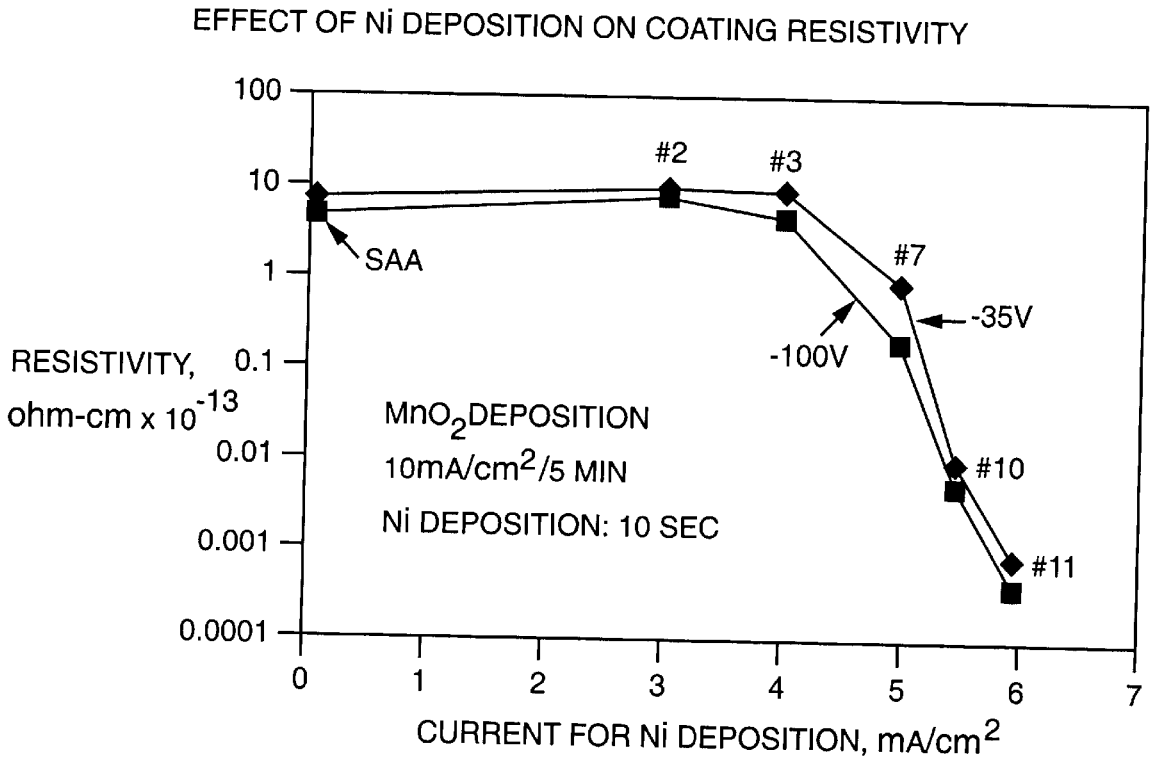
FIG. 1 is a graph showing the effect of nickel deposition on coating resistivity.

The following are examples of coating process conditions and coating properties. Certain conditions were held constant for these examples. The anodized coating was grown in 15 wt % sulfuric acid at 15 V dc and a temperature of 23° C., in a cell with stainless steel mesh cathode. The ac electrolysis for Ni deposition was done in 0.2M $NiSO_4$+ 0.5M $H_3BO_3$ at room temperature in a cell with carbon counterelectrode. This step can be done using a fixed ac voltage or a fixed ac current. For Examples 1 through 8, Ni deposition was done at a constant 50 Hz sinewave ac current. The ac current was monitored with an oscilloscope, and it is the current density corresponding to the ac peak current that is reported here. In Example 9, Ni deposition was done at a constant 50 Hz sinewave ac cell voltage. In Examples 1 through 8, deposition of $MnO_2$ was done from a 0.5M $MnSO_4$ solution at room temperature, using a pulse dc current, in a cell with stainless steel mesh cathode. In these examples, the pulse current is 2 ms on followed by an off period of 18 ms, except for Example 7 in which the pulse conditions were varied. The pulse conditions were set with a square wave generator and pulse time was measured using an oscilloscope. The cell voltage increased during $MnO_2$ deposition. The pulse current density was set at 10 mA/cm$^2$, but the available power source voltage was limited to 28 V, and when the voltage reached that value, the current dropped below 10 mA/cm$^2$. This occurred after about 1–3 minutes of deposition. This is not a necessary condition for $MnO_2$ deposition, but was a characteristic for the particular power source and initial current density selected. In Examples 9–10, the $MnO_2$ deposition conditions were substantially different, as described in those Examples. When a final seal step was used, the sealing was done in boiling water for 10 min. Unless otherwise indicated, the coatings were 12.7 $\mu$m thick and on 6061-T6 alloy.

The electrical resistivity was calculated from current readings at different dc voltages. Most measurements were made with negative bias, as these are most important for space applications. Resistivity with a silver paint contact was measured under bone dry conditions, after equilibration in nitrogen atmosphere over $P_2O_5$ desiccant. Values measured at −35 V are reported here. The resistivity in vacuum plasma was measured in a chamber filled with flowing argon at a pressure of $8\times10^{-5}$ Torr, and plasma electron densities from 2.3 to $0.83\times10^6$ cm$^{-3}$. There were only small differences for the different electron densities. The values reported here are for densities of $2.1–2.3\times10^6$ cm$^{-3}$ and a 60 V negative bias voltage.

Solar absorptance was calculated from reflectance using a spectral reflectometer which integrates over the 250–2500 nm wavelength range. Total emittance was determined from total reflectance.

Example 1

In this example the resistivity and optical properties of a conventional coating and a conductive coating are compared, each in the unsealed state. The Ni deposition was for 10s at 5 mA/cm$^2$ followed by a 10 min $MnO_2$ deposition. The coating properties were as follows:

| | resistivity (ohm-cm) | | arcing | optical properties | |
|---|---|---|---|---|---|
| coating | Ag paint | plasma | threshold (V) | $\alpha$ | $\epsilon$ |
| SAA only | $7.1\times10^{13}$ | $52\times10^{13}$ | −300 | 0.469 | 0.72 |
| conductive | $1.6\times10^{10}$ | $21\times10^{11}$ | −375 | 0.608 | 0.72 |

The resistivity of the conductive coating is more than 3 orders smaller with metal contact, and more than 2 orders smaller with plasma contact in comparison with a conventional sulfuric acid anodized coating (SAA). The arcing threshold does not degrade with this enhanced conductivity. The absorptance ($\alpha$) is higher for the conductive coating, but the emissivity ($\epsilon$) is not changed. The optical properties of the conductive coating are suitable for thermal control applications in space.

Example 2

In this example it is demonstrated that sealing does not degrade the electrical and optical properties of the conductive coating. Two conductive coatings were prepared at the same conditions as for Example 1. One coating was sealed for 10 min in boiling water, and the other was left unsealed. Coating properties were as follows:

| | resistivity (ohm-cm) | arcing | optical properties | |
|---|---|---|---|---|
| coating | plasma | threshold (V) | $\alpha$ | $\epsilon$ |
| not sealed | $41\times10^{10}$ | −300 | 0.691 | 0.74 |
| 10 min seal | $33\times10^{10}$ | −375 | 0.642 | 0.76 |

The sealed coating had superior properties of lower resistivity, higher threshold voltage, and lower optical absorptance. Only the emittance was increased by a small amount.

Example 3

In this example it is demonstrated that conductive coatings can be made on different alloys, and with different thickness coatings. Coatings were prepared on two alloys, with different thickness coating on each alloy. The same Ni deposition conditions were used for both, 8.8 mA/cm$^2$ for 10 s, but the $MnO_2$ deposition time was adjusted to scale with the coating thickness. All coatings were sealed in hot water.

| | thick- | $MnO_2$ | resistivity (ohm-cm) | | optical properties | |
|---|---|---|---|---|---|---|
| alloy | ness | time | plasma | arcing voltage | $\alpha$ | $\epsilon$ |
| 6061-T6 | 12.5 $\mu$m | 10 min | $32\times10^{10}$ | beyond −450 V | 0.678 | 0.76 |
| clad | 1.7 | 1.5 | $15\times10^{11}$ | beyond −450 V | 0.478 | 0.55 |
| clad | 1.7 | 3.0 | $92\times10^{10}$ | beyond −450 V | 0.623 | 0.56 |

The resistivities of the thin coatings on clad alloy are 3–5 times higher than for the coating on 6061-T6, but still orders smaller than for conventional anodized coating.

Example 4

The effect of Ni deposition on coating resistivity is demonstrated in FIG. 1. The Ni deposition current density was varied while holding the deposition time constant at 10 s. The $MnO_2$ process conditions were the same for all samples. The electrical measurements were made with Ag paint at two voltages, −35 and −100 V. The amount of Ni deposited depends on the charge, which is proportional to peak current density times deposition time. There is a threshold, at about 4 mA/cm$^2$, beyond which the resistivity rapidly decreases with increasing Ni deposition to a level 4 orders smaller than for SAA coating. This illustrates the importance of proper selection of Ni deposition conditions in order to get high enough density of sites for subsequent $MnO_2$ deposition.

Ni deposition can also be done at fixed ac voltage. A 15 V SAA coating was treated in the same bath using a 9 V ac voltage. A current peak on the cathodic half-cycle showed Ni deposition was occurring and the specimen visibly darkened after 30 seconds processing due to the Ni deposit.

Example 5

This example demonstrates the effect of $MnO_2$ deposition conditions on coating resistivity and optical properties. The Ni conditions were constant at 5 mA/cm$^2$ peak current for 10 s. The $MnO_2$ time was varied. The samples were unsealed.

| | resistivity (ohm-cm) | | arcing | optical properties | |
|---|---|---|---|---|---|
| $MnO_2$ time | Ag paint | plasma | threshold (V) | α | ε |
| 2.5 min | $10 \times 10^{12}$ | $78 \times 10^{13}$ | −400 | 0.547 | 0.71 |
| 5.0 min | $10 \times 10^{12}$ | $10 \times 10^{13}$ | −340 | 0.574 | 0.72 |
| 10 min | $16 \times 10^{9}$ | $21 \times 10^{11}$ | −375 | 0.608 | 0.72 |

$MnO_2$ deposition starts at the bottom of a pore, and with increasing deposition time the height of the $MnO_2$ column in the pore increases. The sharp decrease in resistivity between 5 to 10 minutes $MnO_2$ deposition time in this example is thought to be due to a large increase in the number of pores in which the columns of conductive $MnO_2$ have reached the outer oxide surface and hence make contact to the Ag paint or vacuum plasma.

Example 6

This example demonstrates a feature of the present invention in that only a fraction of the pores are filled with $MnO_2$. This satisfies the condition where an increase in conductivity is required but only a small increase in absorptance is allowed. This condition was verified by determining the concentration of Mn in a coating using ICP (inductively coupled plasma) analysis, from which the amount of $MnO_2$ was calculated. A coating was processed with ac deposition of Ni at a peak current of 7 mA/cm$^2$ followed by $MnO_2$ deposition for 3 min. The amount of Mn in the coating corresponded to 15.6 μg/cm$^2$ of $MnO_2$. The coating thickness is 12.7 μm. The nominal coating properties are a pore density of $4\times10^{10}$ cm$^{-2}$ with pore diameter of 22 nm, based on measurements of SAA coatings reported in the scientific literature. Using these figures and assuming the $MnO_2$ deposit has the density of bulk $MnO_2$, 4.4 g/cm$^3$, one calculates that the amount of $MnO_2$ found in the coating filled about 2% of the pores. This is not a precise figure, but the magnitude is correct.

In another experiment, the fraction of pores filled with $MnO_2$ was estimated from the density of $MnO_2$ nodules seen on the surface using the scanning electron microscope. This was about $4\times10^{9}$ cm$^{-2}$, corresponding to about 10% filled pores.

Example 7

Table I

Conditions studied for $MnO_2$ deposition which gave uniform coatings.

A listing is given in Table I of pulse dc (and dc) conditions that have been found to produce uniform $MnO_2$ deposits as judged by visual inspection. In all cases the initial current was set at 10 mA/cm$^2$, but the power supply voltage output was limited to 28 V, and when this was reached the current dropped. The voltage limit was reached within a few seconds with steady dc and 50 Hz pulses with 95% duty cycle, whereas with 50 Hz and 5% duty cycle, 10 mA/cm$^2$ was held for the full 10 min process time. The amount of $MnO_2$ in the coating depends on the deposition charge, as well as the current efficiency. Estimates of the charge for several coupons prepared at these conditions are given in the table. Coupons with similar depth of coloration were found to have resistivity of about $10^{11}$ ohm-cm in vacuum plasma. A charge of 0.3 to 1.0 C/cm$^2$ at these process conditions deposits a suitable amount of $MnO_2$ for conductive oxide.

TABLE I

| | |
|---|---|
| Ni deposition: | Bath: 0.2M $NiSO_4$ + 0.5M $H_3BO_3$<br>Sinusoidal wave; 50 Hz; peak current 5 mA/cm$^2$<br>process time 15 seconds |
| $MnO_2$ deposition: | Bath: 0.5M $MnSO_4$<br>initial pulse current 10 mA/cm$^2$,<br>maximum supply V = 28 V<br>process time 10 minutes |

| Pulse time, ms | Frequency, Hz | approx charge C/cm$^2$ |
|---|---|---|
| 0.1 | 500 | |
| 0.5 | 500 | |
| 1.0 | 50 | 0.3 |
| 2.0 | 50 | 0.3 |
| 4.0 | 50 | |
| 8.0 | 50 | 0.6 |
| 19 | 50 | 1.0 |
| 1000 | 0.5 | |
| dc | dc | 1.0 |

Example 8

Conductive coatings were prepared which provide corrosion resistance equal to that of conventional anodized coatings. Five coupons of 6061-T6 alloy, three with conductive coatings and two with conventional SAA coatings, each 12.5 μm thick and sealed in hot water, were given a standard salt spray test in accordance with ASTM B117. Preparation conditions for the conductive coatings, designated as B1, B2 and B4, are given in Table II. After 240 hr exposure there was no evidence of corrosion on any of the conductive coupons. In contrast, one SAA coupon had one corrosion spot, and the other SAA coupon had two corrosion spots, each spot ≦0.4 mm diameter. Whereas the results with SAA are acceptable, the corrosion resistance of the conductive coating is superior.

TABLE II

| Samples for Salt Spray Corrosion Test | | | |
|---|---|---|---|
| Coating conditions for B1, B2, and B4 | B1 | B2 | B4 |
| Ni deposition | | | |
| Bath | <----- 0.2M $NiSO_4$ + 0.5M $H_3BO_3$ -----> | | |
| AC frequency | 50 Hz | 50 Hz | 50 Hz |
| AC peak current | 5 mA/cm$^2$ | 4.5 mA/cm$^2$ | 4 mA/cm$^2$ |
| Deposition time | 10 s | 10 s | 10 s |
| $MnO_2$ deposition | | | |
| Bath | <----- 0.5m $mNso_4$ -----> | | |
| Initial Pulse current | 10 mA/cm$^2$ | 10 mA/cm$^2$ | 10 mA/cm$^2$ |
| Pulse-on time | 2 ms | 2 ms | 2 ms |
| Pulse-off time | 18 ms | 18 ms | 18 ms |
| Deposition time | 15 min | 15 min | 10 min |

TABLE II-continued

| Samples for Salt Spray Corrosion Test | | | |
|---|---|---|---|
| Coating conditions for B1, B2, and B4 | B1 | B2 | B4 |
| Seal | ---------- 10 min boiling water --------- | | |

Example 9

This is an example of the preparation of a conductive black anodize coating.

A 17.5 $\mu$m thick SAA coating on 6061T6 alloy sheet was immersed in 0.2M $NiSO_4$+0.5 M $H_3BO_3$ at 23° C. and nickel was deposited into the pores using a fixed ac voltage condition. This was 50 Hz sinewave with 17 V peak. A suitable voltage in the Ni bath depends on the thickness of the barrier oxide of the SAA coating, which is governed by the cell voltage during SAA anodizing. It is easy to determine a suitable Ni bath voltage by monitoring the current waveshape with an oscilloscope. If the voltage is too low, only an approximate sinewave current is seen. When the voltage is raised, there is a narrow voltage window in which a substantial peak, due to Ni deposition, is superposed on the cathodic cycle. At higher voltage large amounts of gas evolve from the workpiece surface and only a poor deposit is obtained. For 15 V SAA anodize condition, a voltage in the Ni bath of less than 16.5 Vpk produced no noticeable Ni deposition, whereas Vpk>17.5 V caused copious hydrogen evolution which degrades the coating and interferes with Ni deposition. These voltages are measured versus the stainless steel cathode of the cell.

Ni was deposited at 17 Vpk for 15 min. The charge for Ni deposition is estimated from the peak area to be 1.35 C/cm$^2$, which is equivalent to a Ni deposit of 0.4 mg/cm$^2$. Assuming the pores have the same dimensions and distribution as stated in Example 6 and with Ni in all the pores, the Ni deposits are about 0.3 $\mu$m thick, about 2.5% of the coating thickness. This deposit appears black or very dark bronze. $MnO_2$ was deposited from 1M $MnSO_4$ at 23° C. and maintained at pH 3 by periodic addition of $H_2SO_4$. Pulse dc with a pulse current density of 0.68 mA/cm$^2$, 60 ms on and 60 ms off was run for several times. These coatings were examined in cross-section in an optical microscope at 1000×, and the progress of pore-filling was followed. It was judged that 14 minute deposition time filled the pores without significant spillover to the outer surface, and this time was used to prepare specimens. The coatings were dead black. At this low current density the cell voltage stayed at about 17 V and there was no clipping of the current pulse as reported in previous examples. The charge for $MnO_2$ deposition was 2.9 C/cm$^2$.

Example 10

It was found useful to add a step to enhance the Ni deposition and so assure achieving a deep dead black appearance for the final coating. The same SAA coating was deposited as in Example 9, and then a Cu strike was deposited in the pores by immersing the workpiece in 15% $H_2SO_4$+18 g/l $CuSO_4$ at room temperature and electrolyzing for 15 seconds with 50 Hz sinewave voltage with 12 V peak amplitude. This was followed by Ni deposition for 10 minutes at the same conditions as in Example 9. The $MnO_2$ was deposited at the same conditions as in Example 9. The final coating had a deep dead black appearance.

The electrical resistivity of the black anodize coatings of Examples 9 and 10 were measured in dry atmosphere with Ag paint contact. The resistivities for three coatings at −35 V bias were in the range $2.2\times10^8$–$1.2\times10^9$ ohm-cm. This is 10 to 100 times lower than for the conductive oxide coatings in the previous examples, and as much as $10^5$ times less than conventional SAA.

Whereas these examples are limited to certain process conditions, it is understood that a wide range of conditions are likely to produce useful coatings.

CONCLUSIONS AND RAMIFICATIONS

Various embodiments are possible without departing from the scope of the invention. The Examples and Tables are illustrations of possible embodiments and are not restrictive.

Examples have been mostly for coatings on 6061T6 alloy. Any aluminum alloy onto which a porous anodic oxide coating can be deposited also can be coated with conductive oxide. Different properties may obtain insofar as the alloy influences the porous structure and other coating properties. For example, on 5657 alloy the conductive oxide has a much lower optical absorptance than on 6061T6.

Only three coating thicknesses were used in the Examples, ranging from 1.7 to 17.5 $\mu$m. It is likely that conditions can be found to render any porous oxide conductive, regardless of thickness. It is estimated that the coating thickness range of commercial interest will be from 1 to 75 $\mu$m.

The metal deposited at the pore base serves to block further aluminum oxide growth during deposition of $MnO_2$ and serves as a substrate for the $MnO_2$. As long as only a small fraction of pores is filled, the metal deposit does not contribute directly to coating properties, so any metal that will not dissolve during the anodic deposition of $MnO_2$ can be used for this purpose. Nickel and tin baths are suggested because they are used in commercial two-step anodizing processes and so are readily available. Some commercial baths contain combinations of these cations, in addition to cobalt salts and these will also be satisfactory.

The decrease in resistivity depends on the fraction of pores with $MnO_2$ and that depends on the fraction of pores with a metal deposit. In Example 6, it is estimated that two coatings had 2% and 10% of pores filled. To get a significant ($\geqq$100×) reduction in resistivity, without large increase in optical absorptance, pore fraction filled with conducting material should be between 1–15%. There may be particular applications for which larger change in optical properties is allowed, or desirable, and then larger fraction of filled pores can be used.

The Ni deposition can be run at a constant ac cell voltage or constant current. With constant ac voltage, the peak voltage can be set so deposition occurs in only a small fraction of pores, or in most of the pores. The peak voltage should be less than the anodization voltage to make sure that deposition occurs only in a fraction of the pores. For example, for a 15 V SAA coating a peak voltage of 9 V resulted in an initial Ni deposition current of 3.7 mA/cm$^2$ and this decreased to 1.2 mA/cm$^2$ after 5 seconds. An acceptable range for the cell peak voltage is 50 to 100% of the anodization voltage. The peak voltage should be greater than the anodization voltage, by about 1–2 volts, for metal to deposit in the majority of pores. Operating with fixed ac current, we do not have a similar diagnostic for determining a suitable current density. The Ni (or Sn) bath composition and temperature are not critical; conditions in the examples are acceptable, as are other conditions used in commercial anodizing baths.

In the manufacture of electrolytic $MnO_2$, it is found that the oxide conductivity and density are increased by deposition at low pH and at high temperature. The same relation is expected for the deposits in pores. Because deposition is on an aluminum oxide substrate, the pH cannot be too low, nor the temperature too high, or the aluminum oxide will dissolve. We find that a pH range of 3–4 works well, and the temperature can be between ambient (20° C.) and 40° C. There is no reason to operate at a bath concentration lower than 0.5 M $MnSO_4$ and, since saturation at room temperature is about 4.7 M, a convenient upper limit for bath concentration is 4 M. Observations made during the processing of black anodize concerning the deposition of $MnO_2$ are probably relevant to the case of fractional pore filling, since the basic process of depositing $MnO_2$ onto the metal substrate is the same. It was observed that good results were obtained if the voltage during $MnO_2$ deposition remained between 17 and 20 V for a 15 V SAA coating. A current density of 0.68 mA/cm$^2$ at 50% duty cycle generally produced a voltage in this range. If the voltage increased during deposition, then reducing the current to keep the voltage less than 20 V resulted in a good coating. Too high a voltage caused a dark coating to become lighter, indicating loss of $MnO_2$. For black anodize, the best voltage for $MnO_2$ deposition is 2–5 V above the cell voltage for growth of the anodic oxide, e.g., 17–20 V for the 15 V SAA coatings used in the Examples. For Examples 1–8, where only a minimal pore fraction was filled with $MnO_2$ in order to not increase absorptance too much, the voltage rose to 28 V and the current density decreased from its initial value of 10 mA/cm$^2$ during deposition. Use of a pulsed current did not prevent this voltage change. Best practice for $MnO_2$ deposition for this type coating has not been determined, but it is likely that 10 mA/cm$^2$ is an upper limit and a current as low as 0.5 mA/cm$^2$ will be suitable. Too low a current density would lengthen process time which would increase the possibility of dissolution of aluminum oxide in the acidic manganese bath. Pulse current is observed to widen the envelope for acceptable pH and temperature. It has been demonstrated that both steady dc and pulse dc currents are acceptable, with duty cycle varying from 5 to 100%. Only two frequencies, 50 Hz and 8.3 Hz have been used, and both gave good $MnO_2$ deposits.

A necessary condition for low coating resistivity is for the $MnO_2$ deposit to reach the outer surface where it can make electrical contact. This can be detected in several ways. The outer surface of the coating can be examined in plan view in a scanning electron microscope, and the deposition condition when nodules of the $MnO_2$ are first detected can be identified. Alternatively, a coating can be examined in cross-section in an optical microscope and, if the density of pores with $MnO_2$ is great enough, the coating will appear dark over the coating thickness in which the pores contain the conducting oxide. The conditions for which the dark zone extends over the full coating thickness can be identified. In these ways suitable current density, time, and duty cycle can be determined.

The hot water seal can be for a time acceptable to commercial practice, which is likely to be in the range of 5 to 40 minutes, but depends on water temperature and coating thickness. It is common to use chemical additives such as nickel salts in the seal bath, and there are "cold seals" which operate near ambient temperature and rely on other chemical reactions, e.g., precipitation of nickel hydroxide, to close the pores to the atmosphere. These processes have not been evaluated. Whether or not a particular seal process can be used is not crucial to this invention.

The scope of the invention should not be determined by the embodiments illustrated but by the appended Claims and their legal equivalents.

We claim:

1. A process for producing anodized aluminum with increased electrical conductivity, comprising the steps of:

a. anodic oxidation of the surface of an aluminum alloy substrate to deposit a porous anodic oxide, b. electrolytic deposition of a metal into the surface pores of said porous anodic oxide, and c. electrolytic anodic deposition of an electrically conductive oxide into said pores containing the metal deposit, wherein said electrically conductive oxide fills said pores so that it extends to the outer surface of said porous anodic oxide, and wherein said electrically conductive oxide comprises manganese dioxide or a mixture of different oxides of manganese.

2. The process of claim 1, wherein the metal is deposited into said pores essentially randomly distributed over the surface of the aluminum alloy, and wherein the metal is deposited in a range of 1 to 15 percent of the pores, and wherein a thickness of the metal deposit in said pores is small compared to pore length and is in a range of one-tenth micron, whereby the optical properties of said anodized aluminum are in the desirable ranges for space applications.

3. The process of claim 2 further comprising, after the last step, the step of sealing the anodized aluminum by immersion in water at 90 to 100° C. for 5 to 40 minutes.

4. The product produced by the process of claim 3.

5. The product produced by the process of claim 2.

6. The process of claim 1, wherein the metal deposited is selected from the group consisting of: cobalt, nickel, copper, tin, silver, iron and gold.

7. The process of claim 6, wherein the metal deposition is by alternating current electrolysis of a bath containing a salt of one of said metals.

8. The process of claim 7 further comprising, after the last step, the step of sealing the anodized aluminum by immersion in water at 90 to 100° C. for 5 to 40 minutes.

9. The product produced by the process of claim 7.

10. The process of claim 6 further comprising, after the last step, the step of sealing the anodized aluminum by immersion in water at 90 to 100° C. for 5 to 40 minutes.

11. The product produced by the process of claim 6.

12. The process of claim 1, wherein said porous anodic oxide is produced in an aqueous sulfuric acid bath, comprising 10 to 20 weight % sulfuric acid solution at 18 to 30° C., and wherein the electrolytic deposition of said metal into said pores comprises nickel deposition and is produced by alternating current electrolysis in a solution comprising 0.2M nickel sulphate and 0.5 M boric acid at a temperature of 18 to 30° C., with a sinewave frequency of 50–60 Hz and a peak current density of 2 to 8 mA/cm$^2$ for 5 to 30 seconds, and wherein the electrically conductive oxide deposition comprises $MnO_2$ deposition is produced by pulsed direct current deposition in a solution comprising 0.5 to 4.0 M $MnSO_4$, at a temperature of 18 to 40° C. with a pulse frequency of 50 to 60 Hz, a duty cycle of 5 to 50%, with a current density selected to pass a total charge of 0.3 to 1.0 C/cm$^2$ within about 10 minutes.

13. The process of claim 12, wherein the nickel deposition is at a controlled ac voltage.

14. The product produced by the process of claim 13.

15. The process of claim 12, wherein the $MnO_2$ deposition is with steady dc current.

16. The product produced by the process of claim 15.

17. The product produced by the process of claim 12.

18. The process of claim 1, wherein the second step of metal deposition is at sufficient peak ac voltage to cause the metal to be deposited in substantially all of said pores, whereby after the third step of electrolytic deposition of said electrically conductive oxide, the porous anodic oxide is substantially darkened to a black appearance.

19. The product produced by the process of claim 18.

20. The process of claim 18, further comprising, after the first step of anodic oxidation and before the second step of electrolytic deposition of metal, the step of depositing copper into said pores by immersing the anodically oxidized aluminum alloy in a bath of sulphuric acid and copper sulphate and electrolyzing with an ac voltage.

21. The process of claim 1 further comprising, after the last step, the step of sealing the anodized aluminum by immersion in water at 90 to 100° C. for 5 to 40 minutes.

22. The product produced by the process of claim 21.

23. The product produced by the process of claim 1.

24. A process for producing anodized aluminum with increased electrical conductivity, comprising the steps of:

a. anodic oxidation of the surface of an aluminum alloy substrate to deposit a porous anodic oxide, b. deposition of copper into said pores by immersing the anodically oxidized aluminum alloy in a bath of sulphuric acid and copper sulphate and electrolyzing with an ac voltage, c. electrolytic deposition of a metal into the surface pores of said porous anodic oxide at sufficient peak ac voltage to cause the metal to be deposited in substantially all of said pores, and d. electrolytic anodic deposition of an electrically conductive oxide into said pores containing the metal deposit, wherein said electrically conductive oxide fills said pores so that it extends to the outer surface of said porous anodic oxide, and wherein the porous anodic oxide is substantially darkened to a black appearance.

* * * * *

UNITED STATES PATENT AND TRADEMARK OFFICE

CERTIFICATE OF CORRECTION

PATENT NO. : 6,228,241 B1
DATED : May 8, 2001
INVENTOR(S) : Alwitt et al.

It is certified that error appears in the above-identified patent and that said Letters Patent is hereby corrected as shown below:

Column 8,
Line 60/61, Table II, under "Ni deposition" heading, row "Depostion time", right-hand column "B4", delete "10 s" and insert instead -- 15s --.

Signed and Sealed this

Sixteenth Day of July, 2002

*Attest:*

*Attesting Officer*

JAMES E. ROGAN
*Director of the United States Patent and Trademark Office*